US009890013B2

(12) United States Patent
Chen et al.

(10) Patent No.: US 9,890,013 B2
(45) Date of Patent: Feb. 13, 2018

(54) WIRE-WINDING DEVICE

(71) Applicant: FOXCONN INTERCONNECT TECHNOLOGY LIMITED, Grand Cayman (KY)

(72) Inventors: Chi-Ming Chen, New Taipei (TW); Feng Zhou, Kunshan (CN); Kai-Feng Yang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 586 days.

(21) Appl. No.: 14/554,501

(22) Filed: Nov. 26, 2014

(65) Prior Publication Data

US 2015/0144728 A1 May 28, 2015

(30) Foreign Application Priority Data

Nov. 26, 2013 (CN) ..... 2013 1 0612718

(51) Int. Cl.
*B65H 75/44* (2006.01)
*B65H 75/48* (2006.01)

(52) U.S. Cl.
CPC ..... *B65H 75/48* (2013.01); *B65H 75/4434* (2013.01); *B65H 2701/3919* (2013.01)

(58) Field of Classification Search
CPC ..... B65H 75/48; B65H 75/4434; B65H 2701/3919; B65H 75/44
See application file for complete search history.

(56) References Cited

U.S. PATENT DOCUMENTS

| | | | | |
|---|---|---|---|---|
| 7,455,255 | B1 * | 11/2008 | Chao | B65H 75/4431 242/378.1 |
| 7,784,727 | B1 | 8/2010 | Liao | |
| 8,702,025 | B2 * | 4/2014 | Kish | A01K 27/004 242/378.1 |
| 8,870,111 | B2 * | 10/2014 | Kwankijpongsa | B65H 75/4431 242/378 |
| 2007/0001046 | A1 * | 1/2007 | Wu | B65H 75/4434 242/378.1 |
| 2007/0181730 | A1 * | 8/2007 | Yen | B65H 75/4434 242/378.1 |

(Continued)

FOREIGN PATENT DOCUMENTS

| | | |
|---|---|---|
| CN | 2798363 Y | 7/2006 |
| CN | 2935685 | 8/2007 |

(Continued)

*Primary Examiner* — William A. Rivera
(74) *Attorney, Agent, or Firm* — Wei Te Chung; Ming Chieh Chang

(57) ABSTRACT

A wire-winding device comprising: an upper cover; a spiral spring; a rotary base having a groove to accommodate the spiral spring on the bottom surface thereof; a transmission line winding around the rotary base; a lower cover assembled with the upper cover; and a pillar, an outlet, and a wire casing formed on one side of the groove, and two spacers surrounding the peripheral edge of the groove, the pillar having a first end portion which shifts outward to the edge of rotary base, the wire casing having a smooth curved surface formed on the bottom surface thereof near the outlet to enlarge the accommodating space near the outlet and reduce the friction between the transmission line and the spacers.

13 Claims, 13 Drawing Sheets

(56) References Cited

U.S. PATENT DOCUMENTS

| | | | | |
|---|---|---|---|---|
| 2009/0014575 | A1* | 1/2009 | Cheng | B65H 75/4434 242/397 |
| 2009/0159733 | A1* | 6/2009 | Tai | B65H 75/4434 242/371 |
| 2015/0144729 | A1* | 5/2015 | Chen | B65H 75/4434 242/377 |

FOREIGN PATENT DOCUMENTS

| | | | |
|---|---|---|---|
| CN | 201210612 | Y | 3/2009 |
| CN | 101459328 | A | 6/2009 |
| CN | 201797190 | U | 4/2011 |
| CN | 201990333 | U | 9/2011 |
| CN | 102674084 | A | 9/2012 |
| TW | 560521 | | 11/2003 |
| TW | I285184 | B | 8/2007 |
| TW | M348775 | U | 1/2009 |
| TW | M360503 | U | 7/2009 |
| TW | M410736 | U | 9/2011 |

* cited by examiner

WIRE-WINDING DEVICE

BACKGROUND OF THE INVENTION

1. Field of the Invention

The present invention relates to an improved wire-winding device, and more particularly to improve the reliability of stretching out and drawing back for a wire-winding device.

2. Description of the Related Art

In a conventional wire-winding device having a rotary base with spacers, when a transmission line or cable is bent from a wire casing of the rotary base, the cable is easy to rub the spacer. And when the cable is wound around the rotary base, part of the cable will protrude outward.

SUMMARY OF THE INVENTION

Accordingly, an object of the present invention is to provide a wire-winding device which avoids the friction between the transmission line and the spacer and making the transmission smooth.

In order to achieve the object set forth, the wire-winding device comprising: an upper cover; a spiral spring; a rotary base having a groove to accommodate the spiral spring on the bottom surface thereof; a transmission line winding around the rotary base; a lower cover assembled with the upper cover; and a pillar, an outlet, and a wire casing formed on one side of the groove, and two spacers surrounding the peripheral edge of the groove, the pillar having a first end portion which shifts outward to the edge of rotary base, the wire casing having a smooth curved surface formed on the bottom surface thereof near the outlet to enlarge the accommodating space near the outlet and reduce the friction between the transmission line and the spacers.

DESCRIPTION OF PREFERRED EMBODIMENT

Figure 1:
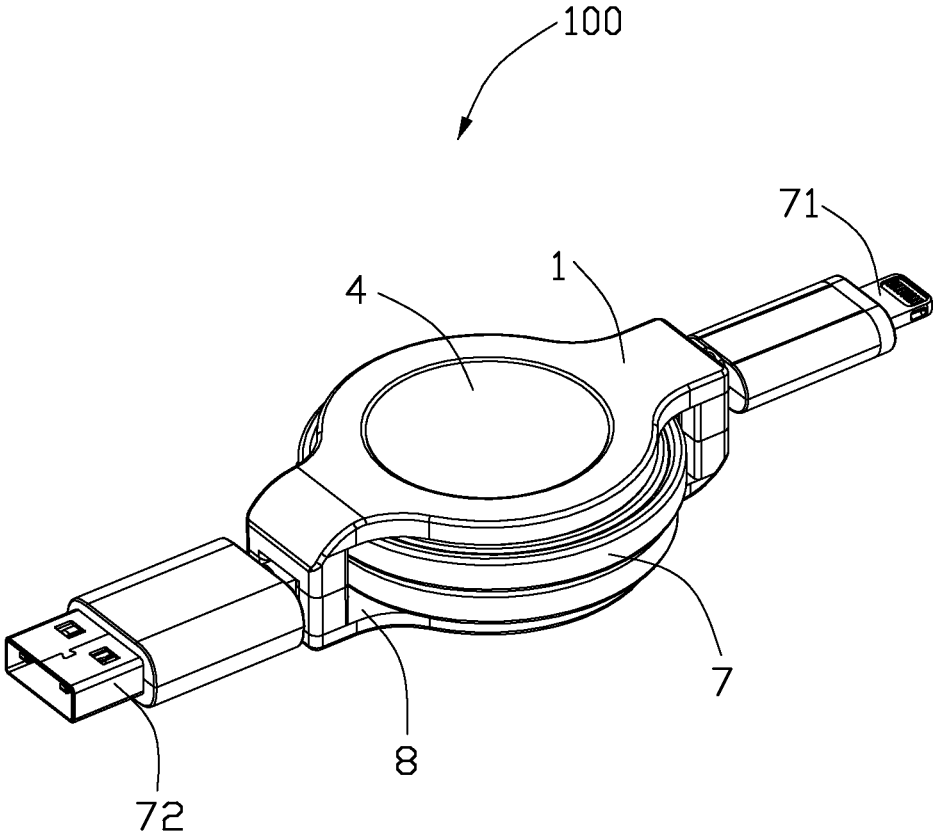
FIG. 1 is an assembled, perspective view of a wire-winding device in accordance with the present invention.
Figure 2:
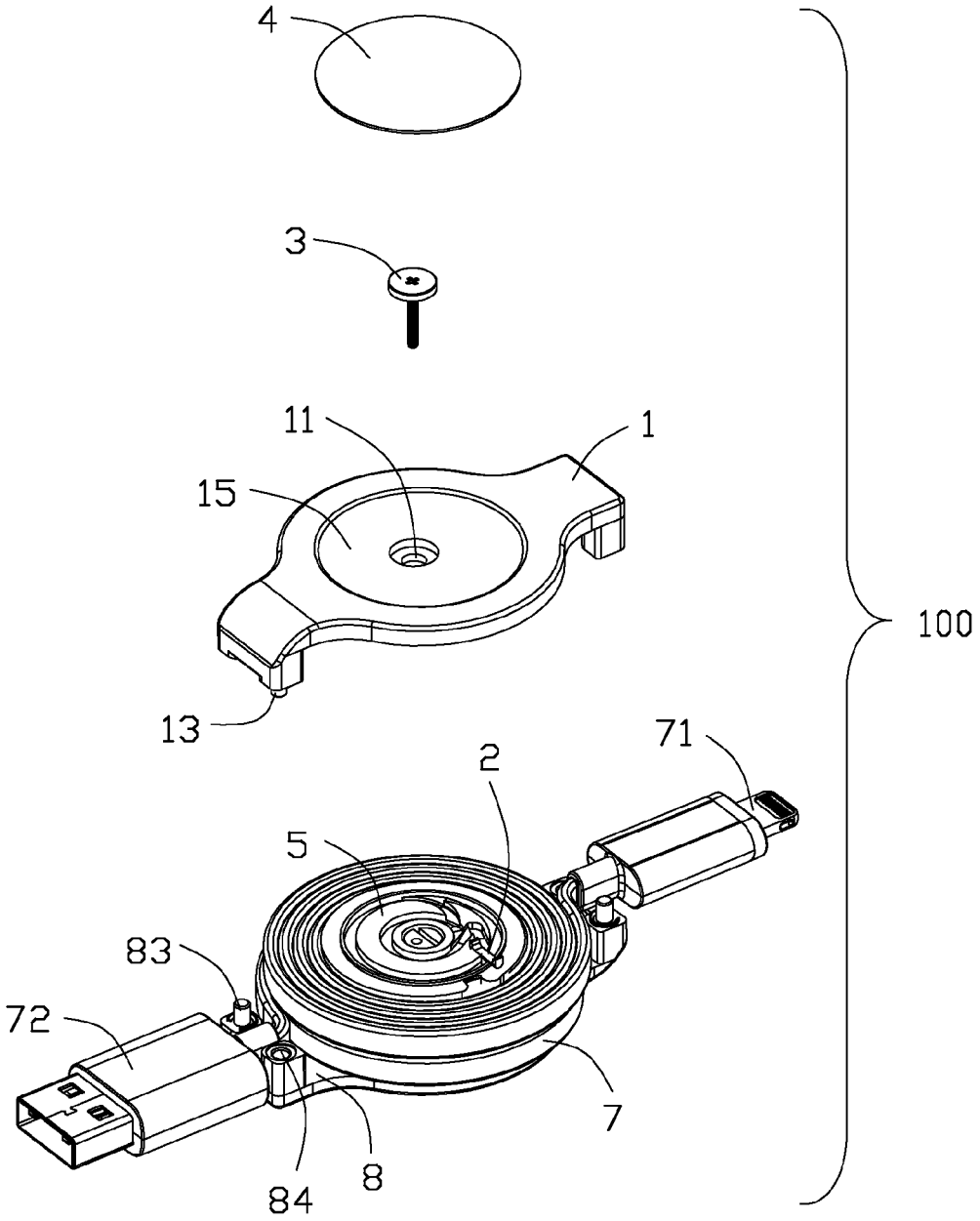
FIG. 2 is a partially exploded, perspective view of the wire-winding device as shown in FIG. 1.
Figure 3:
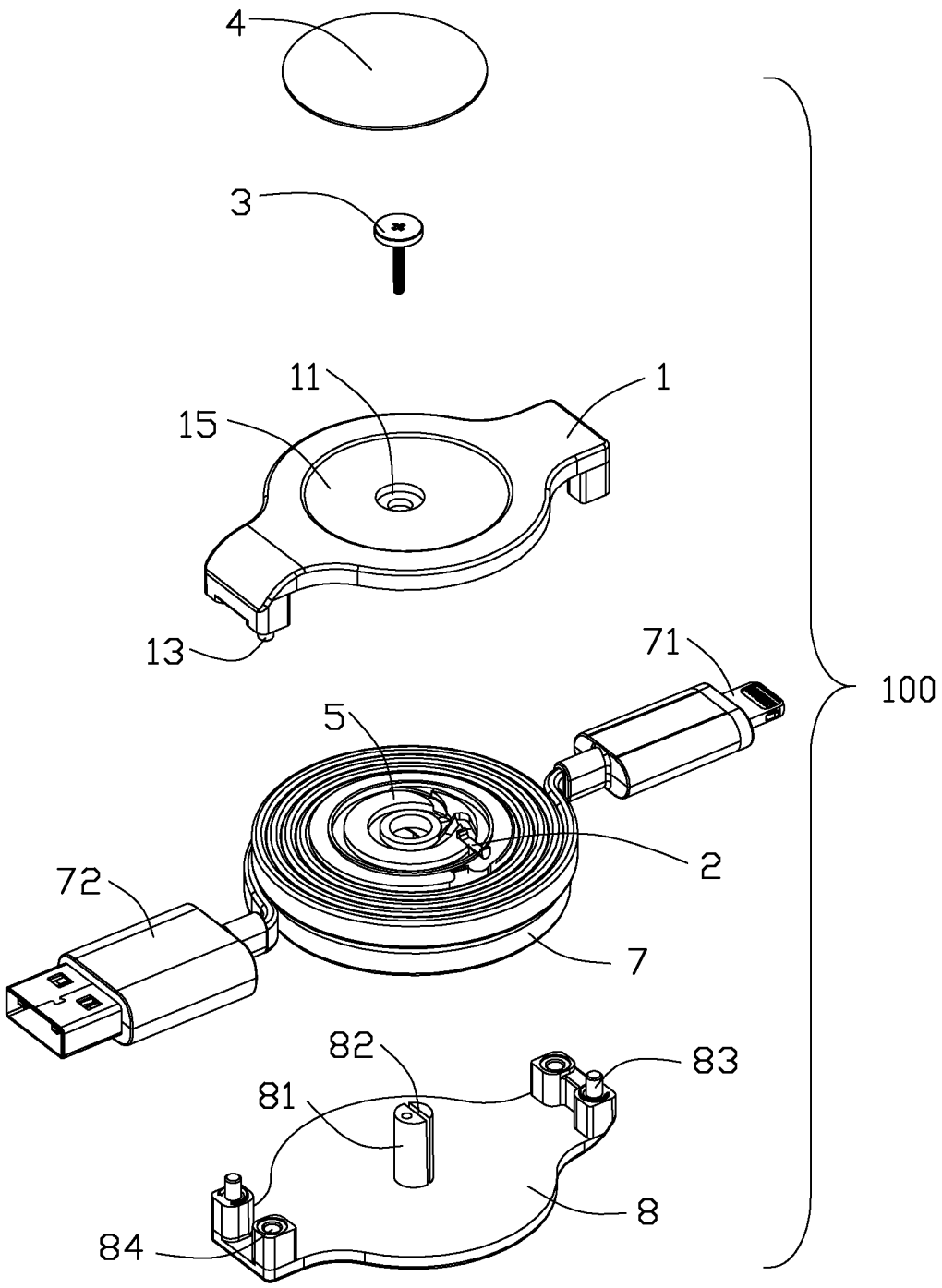
FIG. 3 is a partially exploded, perspective view of the wire-winding device as shown in FIG. 2.

Reference will now be made to the drawings to describe the present invention in detail.

Referring to FIGS. 1 to 5, an improved wire-winding device 100 according to the present invention includes an upper cover 1, a rotary base 5, a spiral spring 6 received into the rotary base 6, a transmission line 7 winding around the rotary base 6 and a lower cover 8 assembled to the upper cover 1. The upper cover 1 has a terraced through hole 11 in the center thereof. And the upper cover 1 has a circular groove 15 formed on the top surface thereof connecting to the through hole 11, a long and narrow rectangle slot 12 deviating a center of the bottom surface of the upper cover 1, a protruding cylinder 13 and a concave hole 14 at each side of the upper cover 1.

Figure 4:
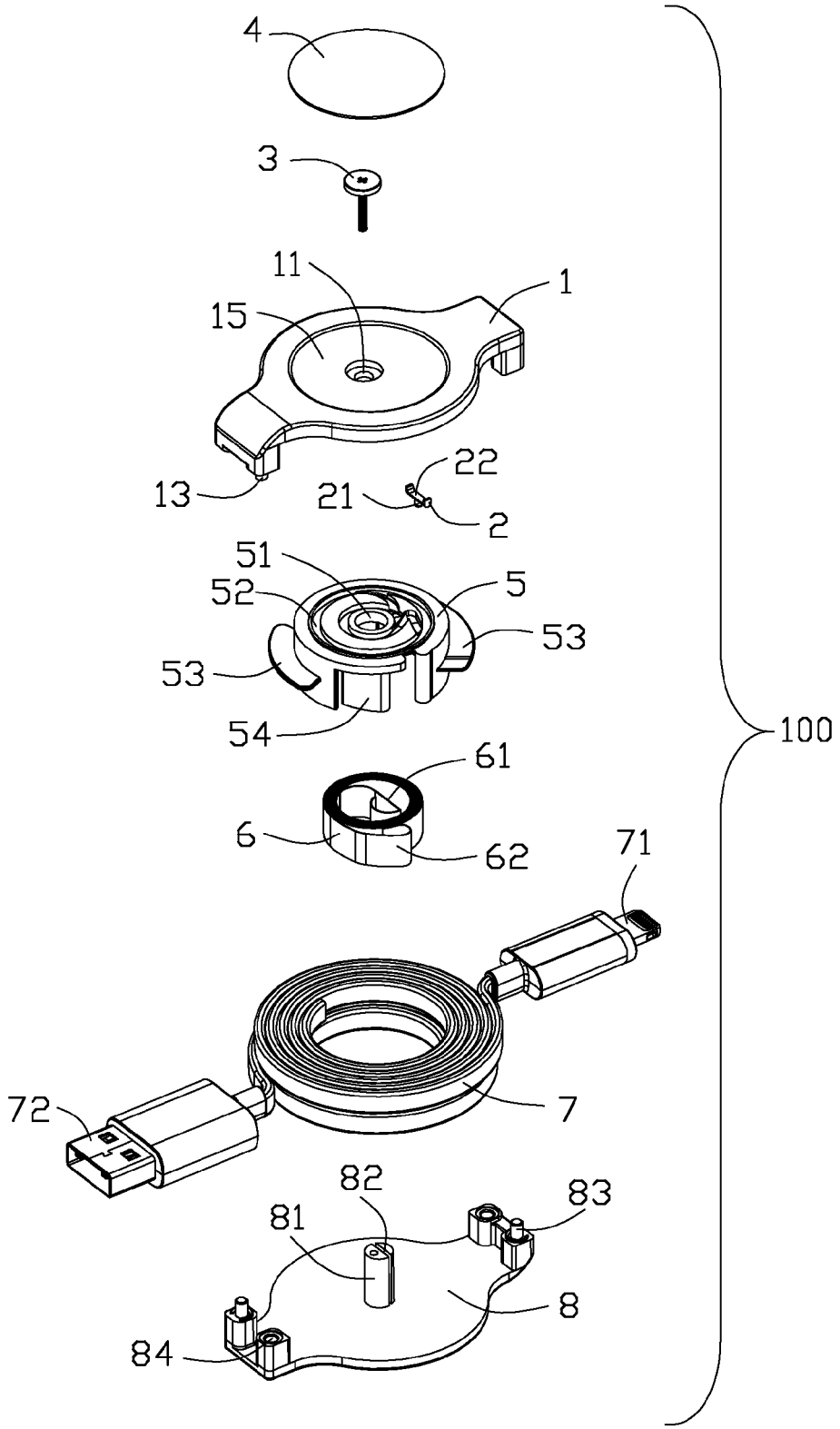
FIG. 4 is an exploded, perspective view of a wire-winding device as shown in FIG. 1.
Figure 5:
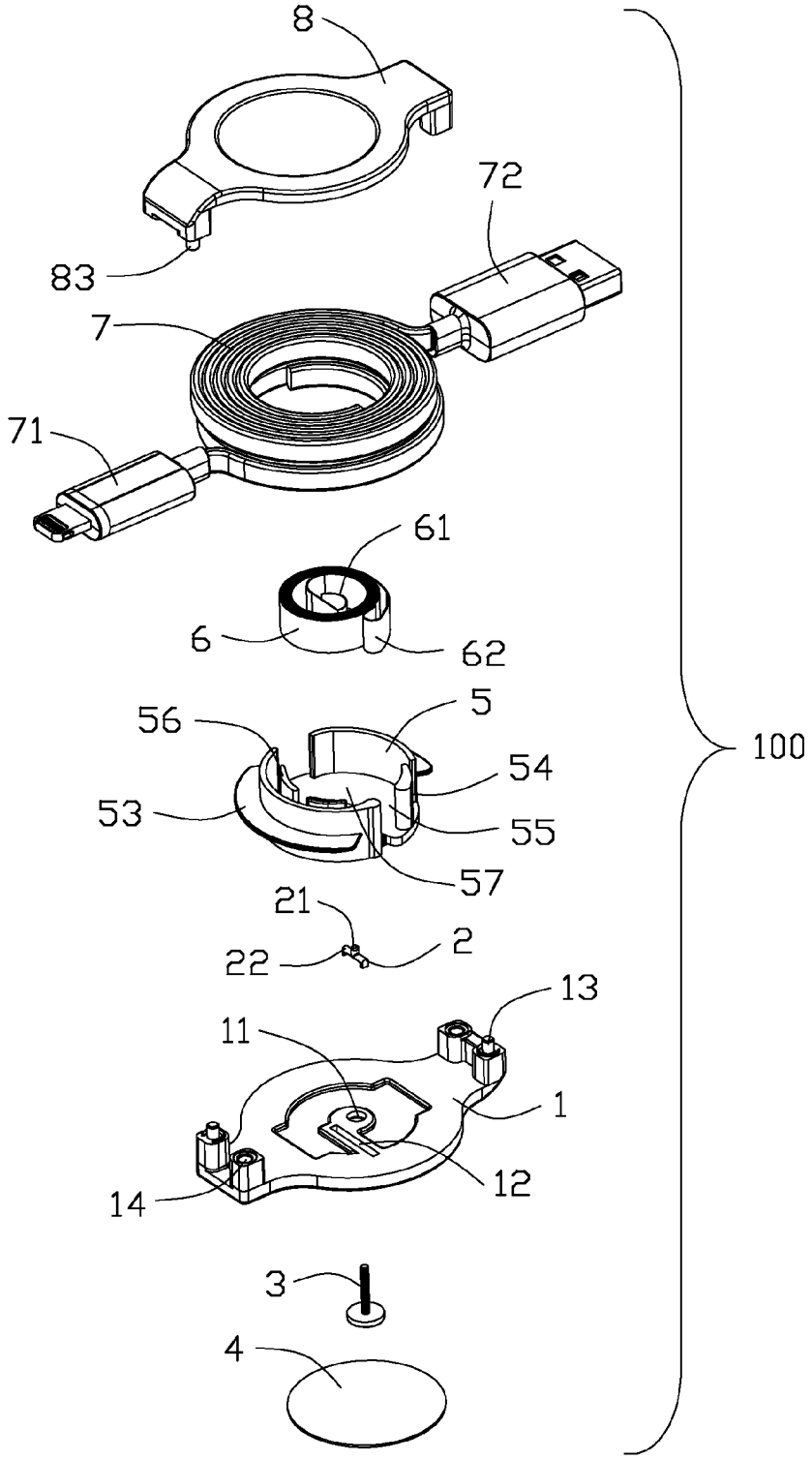
FIG. 5 is an another exploded view of the wire-winding device as shown in FIG. 4.
Figure 6:
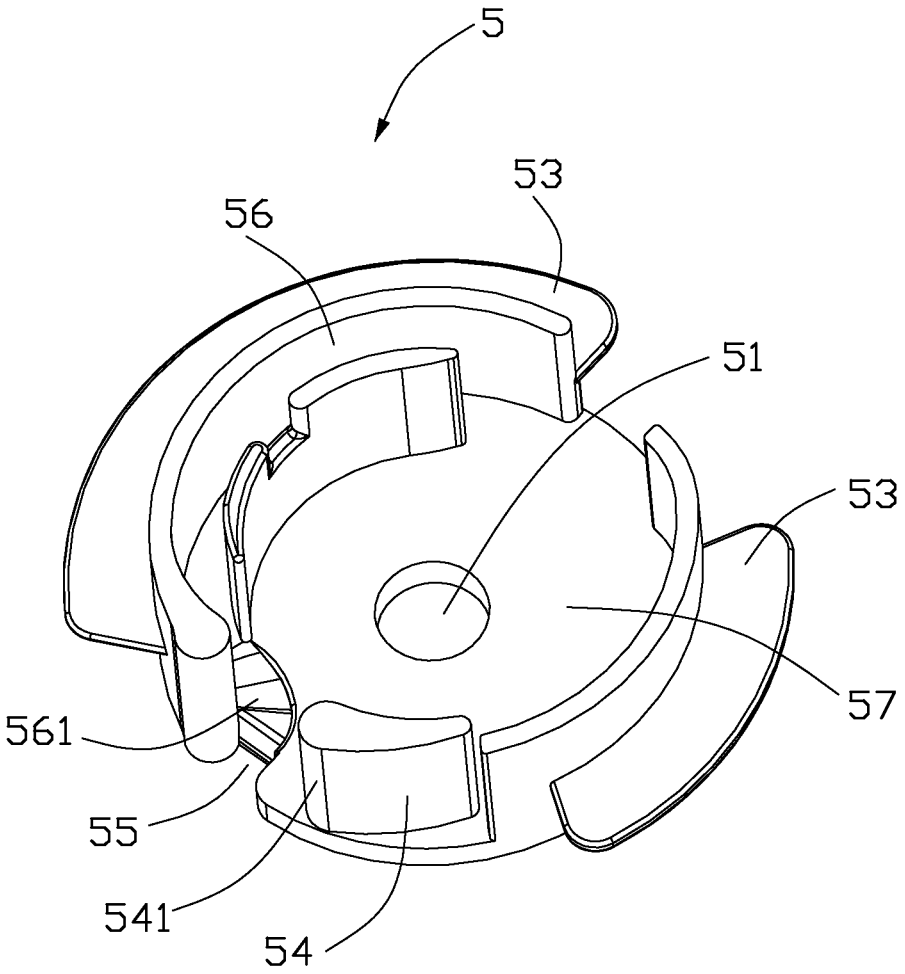
FIG. 6 is a perspective view of the rotary base of the wire-winding device as shown in FIG. 5.
Figure 7:
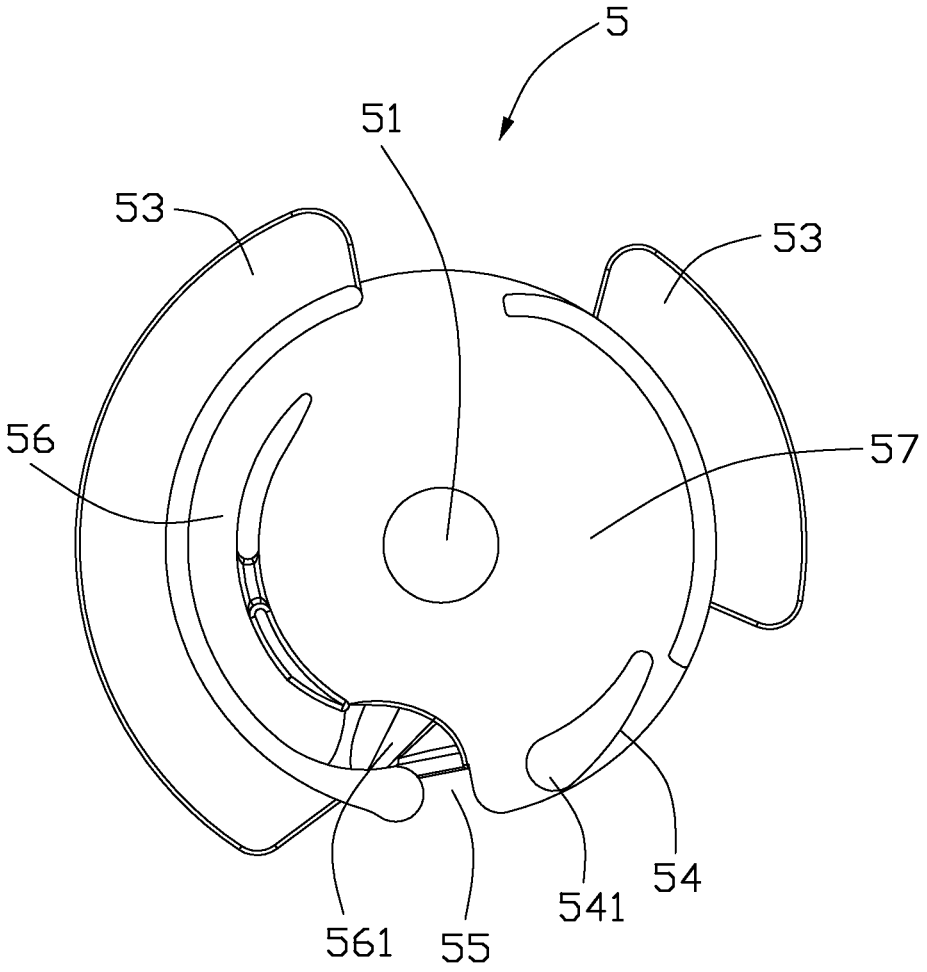
FIG. 7 is a bottom view of the rotary base as shown in FIG. 6.
Figure 8A:
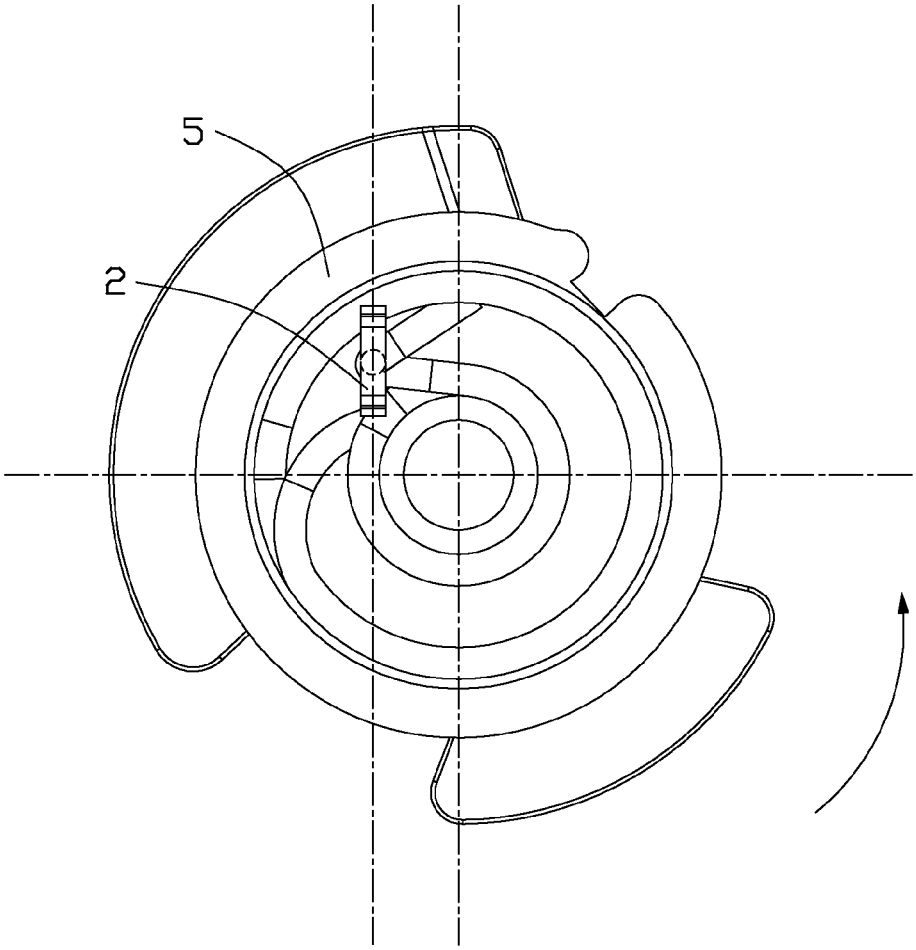
FIGS. 8A-8F are mutual action principle schematic between the elastic positioning element and the annular track.
Figure 8B:
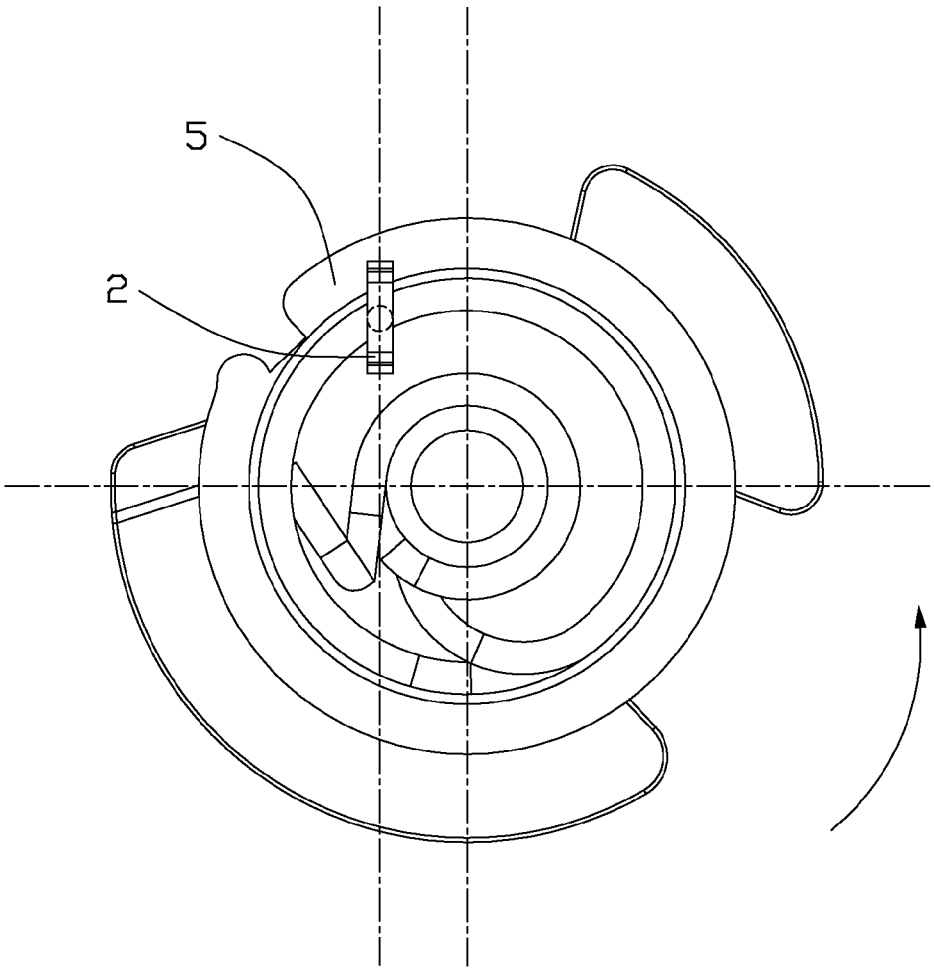
Figure 8C:
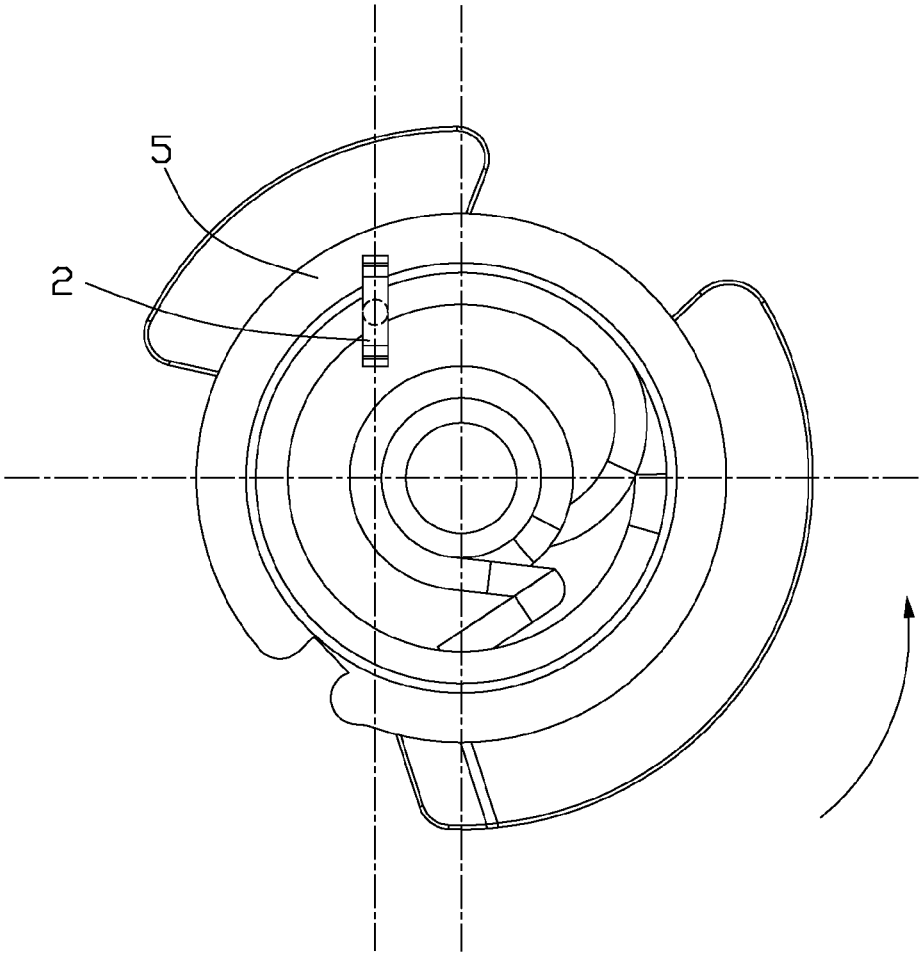
Figure 8D:
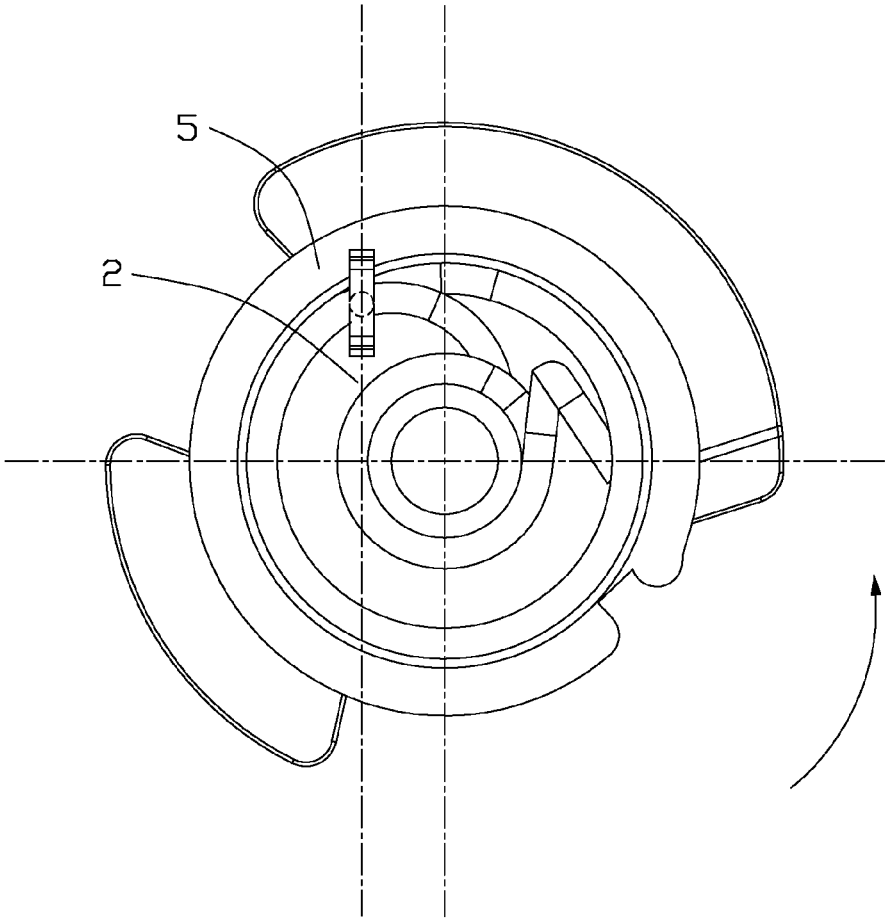
Figure 8E:
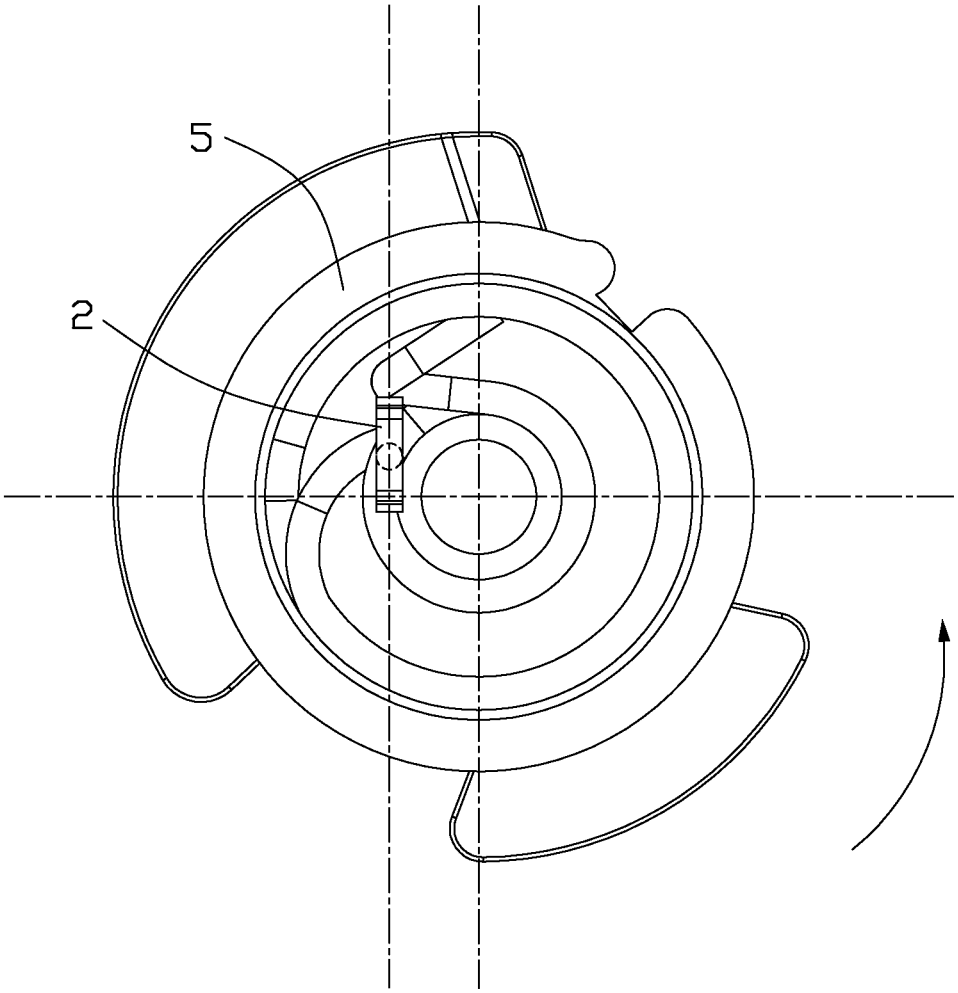
Figure 8F:
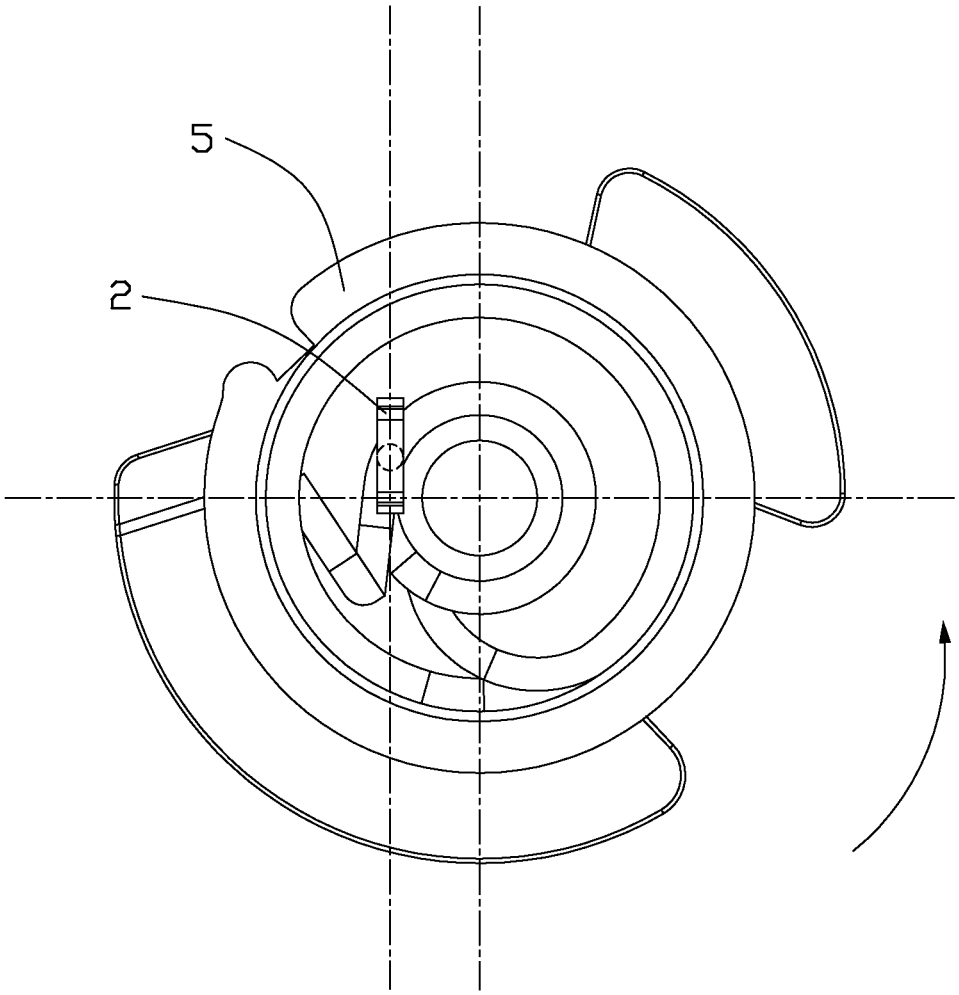

Referring to FIGS. 4 to 6, the rotary base 5 has a through hole 51 in the center thereof and two spacers or dividers 53 formed at the peripheral edge thereof. The spacer 53 divides the transmission line 7 into upper and lower rows. A groove 57 is provided on the bottom surface of the rotary base 5 for positioning the spiral spring 6. There are a pillar 54, an outlet 55 and a wire casing or space 56 on one side of the groove 57. The pillar 54 has a first end portion 541. The first end portion 541 extends to the edge of the rotary base 5 to make the transmission line 7 outside the first end portion 541 protrude outward. There is a smooth curved surface 561 formed on the bottom surface of the wire casing 56 near the outlet 55 extending to the outlet 55. The smooth curved surface 561 has a depth gradually decreasing along a top-to-bottom direction. The enlarged accommodation space near the outlet 55 due to the smooth curved surface 561 can reduce the friction between the transmission line7 near the outlet 55 and the peripheral edge of the spacer 53. The transmission line 7 where it winds around the outlet 55 protrudes outward because the transmission line 7 winds around the outlet 55. Meanwhile the transmission line 7 where it winds around the first end portion 541 of the pillar 54 protrudes outward. So the whole transmission line 7 winding around the rotary base 5 is rounded and smooth.

The rotary base 5 has an annular track 52 on the top surface thereof. The annular track 52 includes an outer race, an inner race and a guide rail connecting the outer race and the inner race. The annular track 52 has a step with different height.

Referring to FIGS. 1 to 5, the spiral spring 6 has a first end portion 61 and a second end portion 62. The second end portion 62 is bent into a semicircle to accommodate the pillar 54 below the rotary base 5. One end of the transmission line 7 is lightning connector 71, the other end is USB connector 72. A circular column 81 protrudes upward from the center of the lower cover 8. The circular column 81 has a groove 82 on one side thereof. The groove 82 accommodates the first end portion 61 of the spiral spring 6 to fix the spiral spring 6. The lower cover 8 has a protruding cylinder 83 and a concave hole 84 at each side thereof. The improved wire-winding device 100 according to the present invention also has an elastic positioning element 2, a screw 3 and a decorative piece 4. The elastic positioning element 2 has a base 22. The base 22 has a fixed part at each side and a elastic part between the fixed parts. A positioning part or guiding protrusion 21 extends from the bottom surface of the base 22. The height of the elastic part is lower than the height of the fixed part. The base 22 of the elastic positioning element 2 is accommodated to the rectangle slot 12 of the upper cover 1. The positioning part 21 is accommodated to the annular track 52.

Referring to FIGS. 1 to 5, the improved wire-winding device 100 according to the present invention is assembling, the spiral spring 6 is accommodated to the groove 57 of the rotary base 5 at first. The second end portion 62 of the spiral spring 6 surrounds the pillar 55 of the rotary base 5.

And then the inner/center portion (not shown) of the transmission line 7 passes through the wire casing 53 and the outlet 54 to make the both ends of the transmission line 7 surround the rotary base 5 in a same rotation direction. The transmission line 7 is divided into upper and lower rows by the spacers 53. The smooth curved surface 561 near the outlet 55 extends to the outlet 55. So the space near the outlet 55 enlarges and it can reduce the friction between the transmission line 7 and the spacers 53. And then the rotary base 5 is installed in the lower cover 8. The first end portion 61 of the spiral spring 6 is accommodated to the groove 82 of the circular column81. The both ends of the transmission line 7 pass through the gap between the protruding cylinder 83 and a concave hole 84 on both sides of the lower cover 8. And then the positioning part 21 is accommodated to the annular track 52 of the rotary base 5. And the upper cover 1 is installed in the lower cover 8. At the same time the base 22 of the elastic positioning element 2 is accommodated to the rectangle slot 12 of the upper cover 1 and it can move back and forth along the rectangle slot 12. The protruding cylinder 13 and the concave hole 14 on both sides of the upper cover 1 respectively join the corresponding concave hole 84 and protruding cylinder 83 on both sides of the lower cover 8. And then the screw 3 is screwed in the circular column 81. At last, the decorative piece 4 is accommodated to the circular groove 15 of the upper cover 1.

Referring to FIGS. 8A to 8F, showing the mutual action principle schematic of the elastic positioning element 2 and the annular track 52 of the improved wire-winding device 100 according to the present invention. The positioning part 21 of the elastic positioning element 2 is accommodated to the annular track 52. When the user pulls the transmission line 7 from the wire-winding device 100 in counter-clockwise direction, the rotary base 5 turns in the same direction. And the annular track 52 rotates with it. And then the base 22 of the elastic positioning element 2 moves in the rectangle slot 22. The position of the positioning part 21 changes relative to the rotary base 5. As shown in FIGS. 8A to 8F, the annular track 52 rotates sequentially 0 degree (latching position), 180 degree, 270 degree, 360 degree, 450 degree and 630 degree. And finally back to the latching position in the first place. It can be seen that when you pull the transmission line 7 outwards, the rotary base 5 starts to rotate in counter-clockwise direction. At this moment the elastic positioning element 2 starts to rotate from the latching position to the outer race. When the rotary base 5 rotates to the 270 degree, the elastic positioning element 2 rotates to the inner race in the clockwise direction through the rail which connects the outer race and the inner race. And then the elastic positioning element 2 rotates in the clockwise direction in the inner race all the time until the whole transmission line 7 is pulled out. On the contrary, when you stop pulling the transmission line 7, the rotary base 5 starts to rotates in the clockwise direction because of the restoring force of the spiral spring 6. If the elastic positioning element 2 is in the inner race of the annular track 52 this moment, the elastic positioning element 2 rotates to the latching position in counter-clockwise direction along the inner race. If the elastic positioning element 2 is in the outer race of the annular track 52, the elastic positioning element 2 will rotates to the latching position in the counter-clockwise direction along the outer race. The elastic positioning element 2 plays an important role in movement and positioning in the annular track 52 through the guiding of the annular track 52 with the steps and the elastic deformation of the elastic part of the base of the elastic positioning element 2. The wire casing 56 has a smooth curved surface 561 formed on the bottom surface thereof near the outlet 55 extending to the outlet 55. So the accommodating space near the outlet 55 enlarges and it can reduce the friction between the transmission line 7 where it bends around the rotary base 5 and the edge of the spacer 53 near the outlet 55 which can reduce the risk of fracture of the transmission line 7 and improves the product life and reliability. Meanwhile the shifting outward of one side of the pillar 54 make the transmission line 7 protrude outward. And working in with the bulge of the transmission line 7 near the outlet 55, the transmission line 7 winding around the rotary base 5 is rounded, smooth and more beautiful.

When the improved wire-winding device 100 according to the present invention is working, the rotary base 5 will rotate if both ends of the transmission line 7 are pulled outward. And the spiral spring 6 is compressed to pull the transmission line 7 out until the positioning part 21 reach the latching position of the annular track 52. The user can pull the transmission line 7 out favorably through above steps. However when the wire-winding device 100 according to the present invention is accommodating the transmission line 7, the user can finish accommodating of the transmission line 7 easily if the positioning part 21 is separated from the latching position of the annular track 52 and the spiral spring 6 pulls the transmission line 7 to the external interlayer of the rotary base 5 by restoring force.

What is claimed is:

1. A wire-winding device comprising:

an upper cover;

a spiral spring;

a rotary base having a groove to accommodate the spiral spring on a bottom surface thereof and two spacers at a periphery thereof, the groove including a wire casing;

a transmission line winding around the rotary base;

a lower cover assembled with the upper cover; and a pillar and an outlet formed on one side of the groove, the pillar having a first end portion which shifts outward to the periphery of the rotary base, the wire casing having a smooth curved surface formed on the bottom surface near the outlet to enlarge the accommodating space near the outlet and reduce the friction between the transmission line and the spacers.

2. The wire-winding device as claimed in claim 1, further having a decorative piece, and wherein the upper cover has a circular groove formed on the upper surface, and the decorative piece is accommodated in the circular groove of the upper cover.

3. The wire-winding device as claimed in claim 1, further having an elastic positioning element having a base and a positioning part protruding from the lower surface of the base, the base having an elastic part and a respective fixed part at each of two ends thereof, the height of the elastic part being lower than the height of the fixed parts.

4. The wire-winding device as claimed in claim 3, wherein the upper cover has a slot deviating from a center of the lower surface thereof, the rotary base has an annular track on the upper surface thereof, the annular track and the slot of the upper cover constitute an orbit, the elastic positioning element being moveable along the orbit in response to a rotational movement of the rotary base.

5. The wire-winding device as claimed in claim 4, wherein the lower cover has a circular column in the center thereof, the circular column has a groove on one side thereof, the lower cover has a protruding cylinder and a concave hole at each side thereof.

6. The wire-winding device as claimed in claim 5, wherein the spiral spring has a first end portion and a second end portion, the second end portion is bent into a semicircle, the first end portion is received in the groove of the lower cover, and the second end portion surrounds the pillar of the rotary base.

7. The wire-winding device as claimed in claim 6, wherein the upper cover has a terraced through hole in the center thereof, the upper cover has a protruding cylinder and a concave hole at each of the two sides thereof.

8. The wire-winding device as claimed in claim 7, wherein the wire-winding device further having a screw screwed in the circular column of the lower cover through the through hole of the upper cover.

9. The wire-winding device as claimed in claim 8, wherein the protruding cylinder and the concave hole of the upper cover are assembled to the concave hole and the protruding cylinder of the lower cover, respectively.

10. The wire-winding device as claimed in claim 1, wherein one end of the transmission line 7 is lightning connector and the other end is USB connector.

11. A wire-winding device assembly comprising:

cover means defining a receiving space;

a rotary base assembled to the cover means and disposed in the receiving space in a rotatable manner;

a spiral spring having two sections fastened to said cover means and said rotary base, respectively, so as to constantly urge the rotary base to move back to an original position;

an annular track formed in the rotary base and defining a latching position thereof;

a positioning element associated with said cover means and including a guiding protrusion moving along said annular track and to resist backward rotation of the rotary base when the guiding protrusion is moved to said latching position; and a transmission wire winding around the rotary base; wherein said rotary base forms a cylindrical structure with a spacer on an exterior surface thereof to divide the transmission wire into upper and lower levels;

one end of the transmission wire extends out of the cover means via the upper level while the other end of the transmission wire extends out of the cover means via the lower level;

the rotary base forms a curved wire space inside the cylindrical structure, and an inner section of the transmission wire is received in the curved wire space;

the rotary base forms a smoothly curved surface in a vertical direction around an outlet beside the curved wire space so as to regulate extension of the transmission wire from the curved wire space to one of the upper levels and the lower levels on the exterior surface without substantial friction;

said outlet is formed between the cylindrical structure and a pillar to which the spiral spring is secured; and the spacer includes a first part and a second part, the first part is located upon a half of the exterior surface, and the second part cooperates with the pillar and is located on the other half of the exterior surface, said second part being smaller than the first part in a spanning range.

12. The wire-winding device assembly as claimed in claim 11, wherein the cylindrical structure and the pillar form corresponding thickened bulged surfaces facing to each other beside the outlet.

13. The wire-winding device assembly as claimed in claim 11, wherein the transmission wire includes an inner section formed around a one half length position thereof and located within a wire space formed inside the cylindrical structure, two opposite ends of said inner section leave away from the wire space at the upper level and the lower level, respectively.

* * * * *